US007083348B2

(12) United States Patent
Watanabe et al.

(10) Patent No.: US 7,083,348 B2
(45) Date of Patent: Aug. 1, 2006

(54) COMBINATION COATING FILM TRANSFER TOOL AND WRITING IMPLEMENT

(75) Inventors: Kazuya Watanabe, Osaka (JP); Hiroshi Kozaki, Osaka (JP); Keisuke Fujii, Osaka (JP); Keiichiro Minegishi, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 53 days.

(21) Appl. No.: 10/994,504

(22) Filed: Nov. 22, 2004

(65) Prior Publication Data

US 2005/0135866 A1 Jun. 23, 2005

(30) Foreign Application Priority Data

Dec. 19, 2003 (JP) ..... 2003/421831

(51) Int. Cl.
*B05C 1/00* (2006.01)
*B43K 29/00* (2006.01)

(52) U.S. Cl. ..... 401/17; 401/18; 401/195

(58) Field of Classification Search ..... 401/17–21, 401/34, 52, 195; 156/540
See application file for complete search history.

(56) References Cited

U.S. PATENT DOCUMENTS

| | | | | |
|---|---|---|---|---|
| 362,404 | A * | 5/1887 | Stockmann | 401/34 |
| 852,514 | A * | 5/1907 | Laube | 401/20 |
| 1,444,155 | A * | 2/1923 | Joecensen | 7/160 |
| 1,508,090 | A * | 9/1924 | Detrick | 401/17 |
| 3,941,488 | A * | 3/1976 | Maxwell | 401/17 |
| 6,461,068 | B1 * | 10/2002 | Holmes | 401/17 |
| 6,582,514 | B1 * | 6/2003 | Yang | 118/76 |
| 6,783,293 | B1 * | 8/2004 | Watanabe et al. | 401/195 |
| 6,921,223 | B1 * | 7/2005 | Marschand | 401/17 |
| 7,014,380 | B1 * | 3/2006 | Ono et al. | 401/17 |
| 7,033,101 | B1 * | 4/2006 | Han | 401/129 |
| 2003/0086741 | A1 * | 5/2003 | Kim | 401/21 |
| 2005/0074271 | A1 * | 4/2005 | Kageyama et al. | 401/195 |

FOREIGN PATENT DOCUMENTS

| | | |
|---|---|---|
| JP | 25056/1998 | 1/1998 |
| JP | 181288/1998 | 7/1998 |

* cited by examiner

*Primary Examiner*—Justine R. Yu
*Assistant Examiner*—Peter deVore
(74) *Attorney, Agent, or Firm*—Howson and Howson

(57) ABSTRACT

In a combination coating film transfer tool and writing implement, a reversible coating film transfer tool can be fitted to the writing implement in either of two ways: one in which the coating film extending past the transfer head is exposed for use, and the other in which the coating film is protected within a housing formed on the writing implement.

7 Claims, 1 Drawing Sheet

COMBINATION COATING FILM TRANSFER TOOL AND WRITING IMPLEMENT

FIELD OF THE INVENTION

This invention relates to coating film transfer tools, that is, tools for transferring a correction film, an adhesive, a decorative coating film, etc., onto a receiving surface. It relates particularly to a transfer tool coupled with a writing implement.

BACKGROUND OF THE INVENTION

Correction fluid applicators and correction tape have been widely used for correcting errors when writing with a ballpoint pen or the like. For convenience, various products such as a writing implement equipped with a correction tool filled with a correction fluid, or a coating film transfer tool loaded with a correction tape, have been conceived. A correction fluid applicator has a peculiar odor due to the solvent component of the fluid, and also requires drying time.

Unexamined Japanese Patent Publications No. 25056/1998 and 181288/1998 disclose a combination transfer instrument and pen, in which a coating film transfer tool loaded with correction tape is coupled to a writing implement by a coupling member. The transfer instrument of the combination comprises a case divided into two parts, and a transfer head within the case. The transfer instrument includes rotatably supported tape supply and tape take-up rollers. The transfer head transfers a transferable agent such as an adhesive or correcting agent by pressing a transfer tape carrying the agent against a receiving surface. One end of this transfer instrument and one end of the writing implement are removably coupled to each other by a separate coupling member.

In the previously known combination pen and transfer instrument, in which a coating film transfer tool is coupled with a writing implement by a coupling member, it is necessary, from time to time, to remove a used coating film transfer tool and to replace it with a transfer tool. At the time of replacement, the coupling member also may accidentally come off the writing implement together with the coating film transfer tool. In such a case, it is difficult to replace the transfer tool. In addition, a cap or shield is provided to protect the transfer head when it is not in use. The cap can be removed, or the shield shifted backward, to expose the tip of the transfer head so that it can be used. However, when the instrument is in a user's pocket, the cap can become detached, or the shield can be accidentally pushed back. In those cases, the film on the correction tape extending over the transfer head can come into contact with the inside of the pocket, creating a mess.

An object of the invention is to provide a combination coating film transfer tool and writing implement, in which the writing implement and the transfer tool are held together securely when the transfer tool is not in use, but separated easily. It is also an object of the invention prevent the mess caused by unintended exposure of the correction tape when the instrument is located in a pocket of the user's clothing.

SUMMARY OF THE INVENTION

In accordance with the invention, the above-described problems are overcome, and the above objects are achieved, by means of a reversible coating film transfer tool, which can be fitted to the writing implement in either of two ways:

one in which the coating film extending past the transfer head is exposed for use, and the other in which the coating film is protected within a housing formed on the writing implement.

More specifically, the combination coating film transfer tool and writing implement in accordance with the invention comprises a coating film transfer tool and a writing implement. The transfer tool has a supply of transfer tape comprising a coating film on a base material, a transfer head for pressing the transfer tape against a receiving surface to effect transfer of the coating film onto the receiving surface, and a take-up mechanism for receiving the base material after the coating film is transferred therefrom. The base material extends from the supply, past the transfer head, to the take-up mechanism. A coupling structure is provided for removably coupling the coating film transfer tool to the writing implement. The coupling structure comprises a first coupling element on the writing implement, and second and third coupling elements on the transfer tool. The second and third coupling elements are alternatively connectible to the first coupling element. The writing implement includes a protective housing arranged to receive the transfer head and to prevent the coating film from coming into contact with surfaces external to the housing when the first and second coupling elements are connected to each other. The protective housing can also receive the transfer head in a position so that the transfer head is external to the housing, and capable of pressing the transfer tape against a receiving surface, when the first and third coupling elements are connected to each other.

The writing implement preferably comprises an body having first and second opposite ends, and has a writing tip at one of the ends, the protective housing being a hollow case permanently connected to the body of the writing implement, and preferably in the form of a substantially cylindrical, unitary part of the body of the writing implement located at the end opposite to the end at which the writing tip is located.

In a preferred embodiment, the transfer tool comprises a transfer tool body having an external flange, and first and second parts on opposite sides of the flange. The second coupling element and the transfer head are located on the first part, and the third coupling element is located on the second part. The protective housing comprises an opening for alternatively receiving the first and second parts of the transfer tool. This opening is surrounded by an end surface, and the second and third coupling members are positioned in relation to the flange so that the flange is engaged with the end surface when the first and second coupling members are connected to each other and also when the first and third coupling members are connected to each other. In this embodiment, the first coupling member preferably comprises an inwardly projecting convex member formed on an internal wall of the housing, and each of the second and third coupling members comprises an outwardly projecting convex member formed on an external surface of the transfer tool body. Preferably, the protective housing has a substantially cylindrical internal wall, the first coupling member comprises an annular, inwardly projecting, convex member formed on the internal wall of the housing, the first and second parts of the transfer tool body on opposite sides of the flange have substantially cylindrical external surfaces, the second coupling member comprises an outwardly projecting, annular, convex member formed on the external cylindrical surface of the first part, and the third coupling member comprises an outwardly projecting, annular, convex member formed on the external cylindrical surface of the second part.

In the combination writing implement and coating film transfer tool in accordance with the invention, the transfer tool is directly coupled to the writing implement, and can be replaced easily when the coating film is exhausted. Moreover, because the transfer tool is reversible, it can be readily moved from an operative position to a position in which the transfer tape is protected. The same coupling element on the writing implement is used for coupling in both positions of the transfer tool, and there is no need for a separate protective cap to prevent exposure of the correction film, and unintended contact with a user's pocket or other objects, when the transfer tool is not in use.

DETAILED DESCRIPTION OF THE PREFERRED EMBODIMENTS

Figure 1:
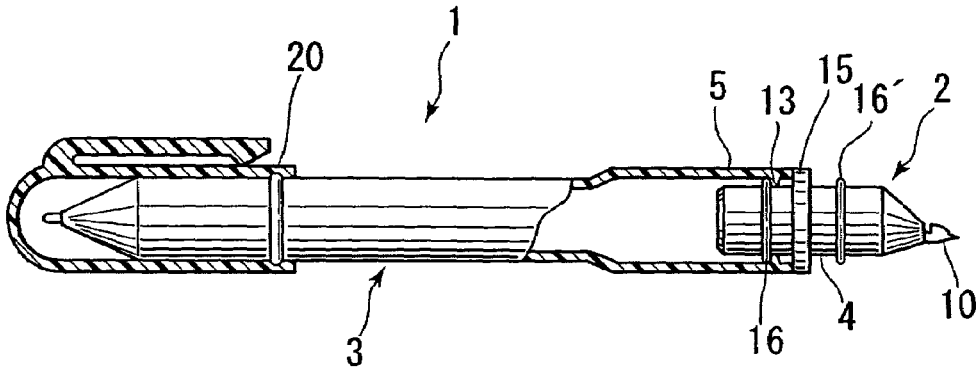
FIG. 1 is a side elevational view, partly in section, of a combination coating film transfer tool and writing implement according to the invention, showing the transfer tool in its operative position.
Figure 3:
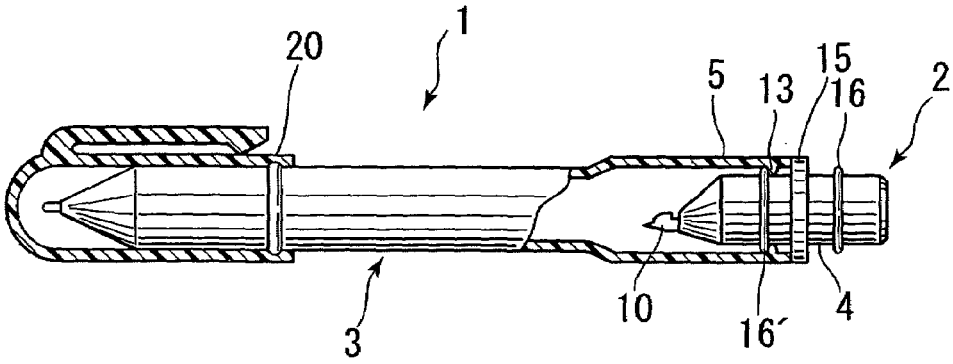
FIG. 3 is a side elevational view, corresponding to FIG. 1, but showing the coating film transfer tool in its reversed position, in which the film extending past the transfer head is in a protected location.

As shown in FIG. 1, the combination coating film transfer tool and writing implement 1 is elongated with its exterior surfaces generally cylindrical in shape. It comprises a coating film transfer tool 2 loaded with a correction tape or other film transfer tape 9 (FIG. 3). A first coupling member 13 is a convex annulus formed on the internal surface of a cylindrical protective housing 5, which is formed as a unitary part of the body 3 of the writing implement. In FIG. 1, the first coupling member 13 is shown in contact with a second coupling member 16, which is an externally projecting convex annulus on a cylindrical outer surface 4 of the transfer tool 2. These coupling members are resilient, and can be moved past each other by the application of force so that the transfer tool can be manually inserted into, and removed from, protective housing 5. As shown in FIG. 1, the transfer tool has an external flange 15, which is in engagement with a circular end surface surrounding the end opening of the housing 5. The distance between the second coupling member 16 and the flange 15 is preferably such that when the flange is in engagement with the end surface of the housing, the coupling members exert a resilient force against each other, holding the transfer tool firmly in place in the housing.

A third annular coupling member 16', which is preferably identical to coupling member 16 is located on the side of flange 15 opposite to the side on which member 16 is located, and the distance between coupling member 16' and flange 15 is the same as the distance between coupling member 16 and the flange. Accordingly, the transfer tool can be reversed and inserted into the protective housing 5 as shown in FIG. 3, so that the coating film on the tape extending past its transfer head 10 is prevented from coming into contact with surfaces external to housing 5. In FIG. 3, as in FIG. 1, the transfer tool is firmly held in place in the housing as a result of a resilient force exerted by the coupling members 15 and 16' against each other. Although the convex coupling member 13 is preferably continuous, as an alternative it can consist of a series of separate projections. Likewise, coupling members 16 and 16' can be discontinuous. However, in the case where both of two cooperating coupling members are discontinuous, they should be configured so that the transfer tool can be snapped into place in protective housing 5, and held firmly, regardless of its rotational position.

Figure 2:
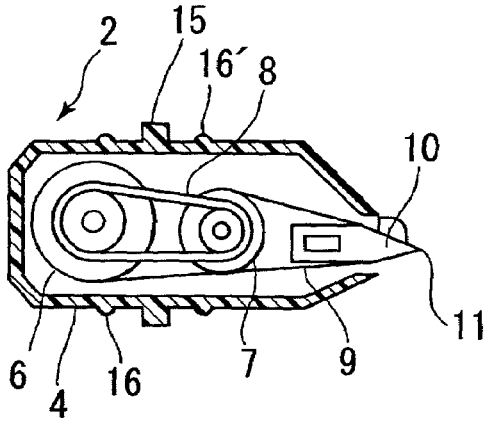
FIG. 2 is a cross-sectional view showing the internal structure of the coating film transfer tool.

As shown in FIG. 2, the coating film transfer tool 2 comprises a case, a transfer head 10 provided at the narrow end of a tapered portion of the case. The transfer head comprises pressing transfer tip 11 at its end. The tip 11 may have a triangular shape or may be in the shape of a small arc, as viewed along the direction of the width of the tape. Inside the case, a supply reel 6 and a take-up reel 7 are rotatable mounted on shafts, and an endless rubber belt 8, on pulleys fixed to the reels, rotates the take-up reel 7 as transfer tape 9 is pulled from the supply reel. The transfer tape is formed by coating one surface of a base tape with a coating film.

In the operation of the transfer tool, the transfer tape 9 is unwound from the supply roll 6 as the coating film is pressed against a receiving surface, by the action of transfer tip 11. The coating film is transferred to the receiving surface, and the part of the base tape from which the coating film has been transferred is wound onto the take-up reel 7.

The writing implement may be an ordinary mechanical pencil, a ballpoint pen with water or oil based ink, a marker pen, or a pen combining two or more different writing elements. When the coating film transfer tool is to be used transfer tool is installed in the protective housing 5 of the writing implement as shown in FIG. 1, with its transfer head extending outward from the protective housing. On the other hand, when the transfer tool is not being used, it is removed, reversed, and reinstalled as shown in FIG. 3 where the coating film on the tape is protected by housing 5 and prevented from contacting external surfaces.

To install the coating film transfer tool 2 in its operative position as shown in FIG. 1, the transfer tool 2 is pushed into housing 5 until its coupling member 16 passes over internal convex coupling member 13 as result of their mutual elastic deformation. Before the elastic deformation is relaxed, flange 15 abuts the end of housing 5, and consequently, the coating film transfer tool 2 firmly connected to in the writing implement in a position in which it can be used to transfer the coating film on its tape to a receiving surface.

On the other hand, when the coating film transfer tool 2 is not being used, it can be removed from protective housing 5 on the writing implement by pulling it with sufficient force to cause coupling member 16 to pass over coupling member 13. It may then be reversed and installed as shown in FIG. 3, by pushing it into housing 5 until coupling element 16' passes over coupling element 13 and flange 15 engages the end surface of housing 5, so that the transfer tool is firmly held in place by the resilient force exerted by the two coupling elements 13 and 16' against each other. In the position shown in FIG. 3, the coating film is enclosed within the housing 5 and prevented from coming into contact with the user's pocket or any other external surface, without the need for a separate protective cap. The writing implement, of course, may have a cap 20 equipped with a clip, or alternatively, the writing element may be made retractable.

Since the transfer tool needs to be miniaturized as much as possible in order to fit the writing implement an endless rubber belt 8, for example an O ring, is favored over a gear drive for rotating the take-up reel with the supply reel. The belt drive is less expensive than a gear drive and the diameters of the pulleys can be smaller than the maximum diameters of the rolls of tape on the supply and take-up reels.

It is desirable to form the coating film transfer tool from a transparent or semitransparent resin to enable visual observation of the transfer tape 9 inside the case. However, the transfer tool may be formed of any suitable material such as an opaque resin, and a part of the case may even be formed of paper. Likewise, the writing implement can be made from any of a variety of suitable materials. The materials, of course, should exhibit the necessary resilience in embodiments where resilient force is relied upon to hold the transfer tool in fixed relationship to the writing implement. The resilience necessary for proper cooperation of the coupling members can be provided by resilience the material of the protective housing 5 and/or the shell of the transfer tool. Thus, it is possible for the coupling members themselves to be made from a material lacking, or having a very low degree of, deformability.

Various modifications can be made to the coupling structure. For example, threads can be formed on the inner surface of the housing 5 and engaged with threads formed on the outer surface 4 of the transfer tool adjacent both ends thereof. As a further alternative, the coupling structure can be formed from cooperating concave and convex coupling elements, such as an annular groove and a cooperating annular projection. Likewise, a hooking structure such as a "bayonet" joint, or even a magnetic coupling structure can be used. These coupling structures can be used alone or in combination. In short, the coupling structure can take any form as long as it allows easy attachment and removal of the coating film transfer tool to and from the writing implement.

We claim:

1. A combination coating film transfer tool and writing implement comprising:

a coating film transfer tool having a supply of transfer tape comprising a coating film on a base material, a transfer head for pressing said transfer tape against a receiving surface to effect transfer of said coating film onto said receiving surface, and a take-up for receiving said base material after said coating film is transferred therefrom, said base material extending from said supply, and past said transfer head to said take-up;

a writing implement; and a coupling structure for removably coupling said coating film transfer tool to said writing implement;

wherein said coupling structure comprises a first coupling element on said writing implement, and second and third coupling elements on said transfer tool, the second and third coupling elements being alternatively connectible to said first coupling element, the writing implement including a protective housing arranged to receive said transfer head and to prevent said coating film from contacting surfaces external to said housing when said first and second coupling elements are connected to each other, and wherein said transfer head is external to said housing and positioned to be capable of pressing said transfer tape against a receiving surface, when said first and third coupling elements are connected to each other.

2. A combination coating film transfer tool and writing implement claimed in claim 1, wherein said writing implement comprises an body having first and second opposite ends, and having a writing tip at one of said ends, and wherein said protective housing is a hollow case permanently connected to said body of the writing implement.

3. A combination coating film transfer tool and writing implement according to claim 2, wherein said protective housing is formed as a unitary part of said body of the writing implement.

4. A combination coating film transfer tool and writing implement according to claim 2, wherein said protective housing is substantially cylindrical in shape.

5. A combination coating film transfer tool and writing implement according to claim 2, wherein said transfer tool comprises a transfer tool body having an external flange, and first and second parts on opposite sides of said flange, said second coupling element and said transfer head being located on said first part, and said third coupling element being located on said second part, and wherein said protective housing comprises an opening for alternatively receiving said first and second parts of the transfer tool, said opening being surrounded by an end surface, and said second and third coupling members being positioned in relation to said flange so that the flange is engaged with said end surface when said first and second coupling members are connected to each other and also when said first and third coupling members are connected to each other.

6. A combination coating film transfer tool and writing implement according to claim 5, wherein said first coupling member comprises an inwardly projecting convex member formed on an internal wall of said housing, and wherein each of said second and third coupling members comprises an outwardly projecting convex member formed on an external surface of said transfer tool body.

7. A combination coating film transfer tool and writing implement according to claim 6, wherein said protective housing has a substantially cylindrical internal wall, said first coupling member comprises an annular, inwardly projecting, convex member formed on said internal wall of the housing, said first and second parts of said transfer tool body on opposite sides of said flange have substantially cylindrical external surfaces, said second coupling member comprises an outwardly projecting, annular, convex member formed on the external cylindrical surface of said first part, and said third coupling member comprises an outwardly projecting, annular, convex member formed on the external cylindrical surface of said second part.

* * * * *